US005655965A

United States Patent [19]

Takemoto et al.

[11] Patent Number: 5,655,965

[45] Date of Patent: Aug. 12, 1997

[54] SCREEN DISPLAY TYPE SLOT MACHINE WITH SEEMINGLY FLOWING CONDITION OF MOVING SYMBOLS

[75] Inventors: Takatoshi Takemoto; Kazunari Kawashima; Taizo Higaki, all of Tokyo, Japan

[73] Assignee: Kabushiki Kaisha Ace Denken, Tokyo, Japan

[21] Appl. No.: 424,334

[22] PCT Filed: Oct. 22, 1992

[86] PCT No.: PCT/JP92/01378

§ 371 Date: Apr. 24, 1995

§ 102(e) Date: Apr. 24, 1995

[87] PCT Pub. No.: WO94/08674

PCT Pub. Date: Apr. 28, 1994

[51] Int. Cl.[6] ..... A63B 71/06

[52] U.S. Cl. ..... 463/20; 463/30; 463/31; 273/142 R; 273/143 R

[58] Field of Search ..... 273/138 R, 143 R, 273/142 B, 138 A, 142 R, DIG. 28, 32 R, 461; 364/410, 412; 353/121; 463/1, 16, 20, 30–31

[56] References Cited

U.S. PATENT DOCUMENTS

| | | | |
|---|---|---|---|
| Re. 34,244 | 5/1993 | Hagiwara | 463/20 |
| 3,729,315 | 4/1973 | Conklin et al. | 473/156 |
| 3,769,894 | 11/1973 | Conklin | 473/156 |
| 4,086,630 | 4/1978 | Speiser et al. | 473/155 |
| 4,256,368 | 3/1981 | Task | 353/121 |
| 4,437,672 | 3/1984 | Armantrout et al. | 473/153 |
| 4,448,419 | 5/1984 | Telnaes | 273/143 R |
| 4,482,223 | 11/1984 | Koch et al. | 353/121 |
| 4,514,063 | 4/1985 | Wang et al. | 353/121 |
| 4,711,451 | 12/1987 | Pajak et al. | 273/143 R |
| 4,712,799 | 12/1987 | Fraley | 273/143 R |
| 4,788,600 | 11/1988 | Marsiglio et al. | 353/121 |
| 5,123,649 | 6/1992 | Tiberio | 273/143 R |
| 5,154,421 | 10/1992 | Hamano | 273/143 R |
| 5,209,479 | 5/1993 | Nagao et al. | 273/143 R |
| 5,333,874 | 8/1994 | Arnold et al. | 473/156 |
| 5,375,830 | 12/1994 | Takemoto et al. | 273/143 R |

FOREIGN PATENT DOCUMENTS

| | | |
|---|---|---|
| 0 070 613 | 1/1983 | European Pat. Off. . |
| 1-32 29 634 | 2/1984 | Germany . |
| 1-198584 | 8/1989 | Japan . |
| 2-16154 | 4/1990 | Japan . |
| 2-224687 | 9/1990 | Japan . |
| 4-220274 | 8/1992 | Japan . |
| 4-220275 | 8/1992 | Japan . |
| 57-139378 | 8/1992 | Japan . |
| 1 466 765 | 3/1977 | United Kingdom . |
| WO 92/11070 | 7/1992 | WIPO . |

*Primary Examiner*—Jessica Harrison
*Assistant Examiner*—Mark A. Sager
*Attorney, Agent, or Firm*—Lowe, Price, LeBlanc & Becker

[57] ABSTRACT

A slot machine comprising display means (110) having a display surface provided on a plane opposed to a player, display control means (401) for controlling the display means (110) so as to display a still condition and a game play condition for each display window, start instruction means (108) for accepting a game play start instruction and instructing the display control means to start operation, stop instruction means (109) for accepting an instruction for stopping symbol change for each display window and instructing the display control means (401) to stop operation, and game control means (403) for controlling game progress, wherein the improvement comprises storage means for storing a plurality of symbol patterns and a plurality of flow condition patterns for providing a seemingly flowing condition in a state in which the symbol patterns move, the display control means (401) for alternating the pattern read from the storage means between the symbol and flow condition patterns in response to the game progress state and causing the display means to display the read pattern for each display window. Therefore, a dynamic and interesting slot machine can be provided.

15 Claims, 18 Drawing Sheets

EXTERNAL VIEW A

EXTERNAL VIEW B

ILLUSTRATION OF DISPLAY SCREEN CHANGE WHEN STILL PICTURES ARE USED
(STILL PICTURES ARE DISPLAYED AS THEY ARE)

DISPLAY UNIT SYMBOL OUTPUT BLOCK DIAGRAM

ILLUSTRATION FOR ADDRESSING

ACCELERATION PATTERN DATA CONFIGURATION

ACCELERATION PATTERN DATA CONFIGURATION WHEN DYNAMIC IMAGE IS CHANGED

CONSTANT SPEED PATTERN DATA CONFIGURATION

DECELERATION PATTERN DATA CONFIGURATION

SCREEN DISPLAY TYPE SLOT MACHINE WITH SEEMINGLY FLOWING CONDITION OF MOVING SYMBOLS

TECHNICAL FIELD

This invention relates to a screen display type slot machine comprising a display unit on a game board of the slot machine.

TECHNICAL BACKGROUND

In a conventional slot machine, three rotating drums, having various symbols on the surface thereof, rotate. When a game start command is received, the three rotating drums are rotated and when the player presses stop switch buttons in sequence, the drum rotation is stopped. A predetermined number of game play media are paid out to the player for a winning game play in response to the combination of the symbols after the drum rotation stops.

Another slot machine comprises a CRT provided on its front in place of the rotating drums and displays a total of nine symbols on three rows x three columns of the CRT. Further, slot machines comprising a liquid Crystal display for displaying symbols are provided as described in Japanese Patent Laid-Open Nos. Hei 4-220274 and 4-220275 and International Publication No. WO92/11070. These kinds of slot machines which display symbols include slot machines which display nine symbols on three rows x three columns of the display window and slot machines which display three symbols on each of the three display windows provided for each row. In the present specification, the row of the display screen is referred to as display window.

When symbols are displayed on the CRT or the liquid crystal display, the symbols are replaced at given frame period intervals in order to display them as if the symbols had actually rotated. However, the frame period is 1/60 or 1/30 sec, and the player only sees the symbols flicker if the symbols are simply replaced at this rate. Thus, the player cannot feel as if the symbols had rotated, as in the rotating drum type slot machine, and it is not as interesting.

DISCLOSURE OF INVENTION

It is therefore an object of the invention to provide an dynamic and powerful screen display type slot machine.

To this end, according to the invention, there is provided a screen display type slot machine comprising display means having a display surface provided on a plane opposed to a player, display control means for controlling the display means so as to display a still condition and a game play condition for each display window, start instruction means for accepting a game play start instruction and instructing the display control means to start operation, stop instruction means for giving a symbol change stop instruction for each display window, game control means for controlling game progress, and storage means for storing symbol images representing a plurality of types of symbols and flow images representing a seemingly flowing condition in which the types of symbols move when symbols are still, the display control means for selectively reading either the symbol image or the flow image in response to the game progress state and causing the display means to display the read image for each display window.

The display control means can select and read the flow image when the screen display type slot machine should be in a high-speed rotation display mode.

The display control means can previously define a method for selecting either a symbol image or a flow image from the storage means.

As the selection method of the display control means, a symbol image may be selected when the still condition is displayed, and a flow image may be selected when symbols are changed for display of the game play condition.

When start detection means, for detecting a lapse of a predetermined time since a start instruction was given through the start instruction means, and stop detection means, for detecting a lapse of a predetermined time since a stop instruction was given through the stop instruction means, are further included, as the pattern read change time, when detection is done by the start detection means, the display control means can assume that the slot machine should be in a high-speed rotation display mode and can read a flow image from the storage means and when detection is done by the stop detection means, can read a symbol image from the storage means. Alternatively, instead of providing the stop detection means, the stop instruction means may output the stop instruction after a predetermined time has elapsed since a start instruction was given through the start instruction means.

To prepare a flow image, a rotation drum type slot machine is operated, an optical camera or a video camera is used for shooting at a shutter speed of a predetermined display update interval, a picked-up image is converted into digital data, and the digital data is stored as the flow image. Also, a rotation drum type slot machine can be operated, a CCD (charge coupled device) video camera can be used for shooting at a shutter speed of a predetermined display update interval, and picked-up image data can be stored. Further, a symbol image may be moved one dot at a time by a rotation movement distance of a rotation drum type slot machine at a predetermined display update interval, all resultant symbol images may be added together each time the symbol image is moved one dot at a time, and addition result data may be stored as the flow image.

As described above, symbols moving at the speed of 1/60 or 1/30 sec rather than still pictures are provided and displayed as symbols during the rotation operation.

Thus, each picture is seen as it flows, so that the clearness of each picture is lost and the player can feel as if the entire drum is rotated as a whole. Since what each picture is can be roughly determined on the seemingly flowing screen, the condition is satisfactory to experienced customers utilizing hand to eye coordination. The use of good hand to eye coordination means that the player senses what symbol will come to what place when stopping the drums and presses the stop switches so as to output desired symbols at proper timing.

By displaying a still picture for the rotation operation during the rotation operation, the player can see it as if the picture actually rotated and can roughly determine what each symbol is, so that the player can make use of hand to eye coordination.

Further, the display control means may update the read image (symbol or flow image) at different positions on the display screen during display update, whereby the symbol or flow image can be scrolled on the screen.

Also, to update the read pattern at the different positions, the display control means moves it by a distance corresponding to a movement distance in a condition in which the display window virtually rotates. Further, upon receipt of an instruction from at least either of the start instruction means or the stop instruction means, the display control means may change the magnitude of the movement distance.

The screen display type slot machine can further include a stop mode for updating the read image at the same position on the display screen during display update, an acceleration mode for moving the read image by a distance corresponding to a movement distance of a symbol position in a condition in which the display window virtually rotates for displaying it at different positions on the display screen and acceleratively increasing the magnitude change of the movement distance, a constant speed mode for holding the movement distance constant, and a deceleration mode for decreasing the magnitude of change of the movement distance, wherein the display control means can select a symbol image in the stop mode, change from symbol image selection to flow image selection in the acceleration mode, select the flow image in the constant speed mode, and change from flow image selection to symbol image selection in the deceleration mode.

The display control means can further include a plurality of deceleration modes having different magnitudes of decrease change of the movement distance and upon receipt of a stop instruction from the stop instruction means, may select one from the deceleration modes corresponding to a predetermined position of a symbol on the display screen.

Thus, the symbol move mode of the slot machine for displaying symbols as if they rotated on the CRT or LCD screen can be changed from stop mode to acceleration mode to constant speed mode to deceleration mode to stop mode. Further, which of symbol and flow images is to be selected can be determined as a read pattern in each mode.

The acceleration mode is entered while the stop to constant speed transition is made. During the acceleration mode, the symbol movement distance is calculated from a predetermined speed graph for each frame period and the symbol image is updated and displayed. When the speed becomes a specific speed or a specific time has elapsed in the acceleration mode, a change is made so as to read a flow image. In the constant speed mode, the flow image is continuously read. Likewise, the deceleration mode is entered while the constant speed to stop transition is made. During the deceleration mode, the movement distance is calculated from the speed graph for reduction. When the speed becomes a specific speed or a specific time has elapsed in the deceleration mode, a change can be made so as to read a symbol image.

Thus, by changing the display speed, the rotation speed rises gradually for a short time; meanwhile, the read pattern is changed from symbol image to flow image and the rotation speed soon becomes constant. When a stop instruction is accepted, the rotation speed slows down gradually and the read pattern is changed from flow image to symbol image and the drum soon stops, thereby providing a more realistic motion resembling the drum rotation of a mechanical slot machine.

BEST MODE FOR CARRYING OUT THE INVENTION

Referring now to the accompanying drawings, there is shown one embodiment of the invention.

Figure 1:
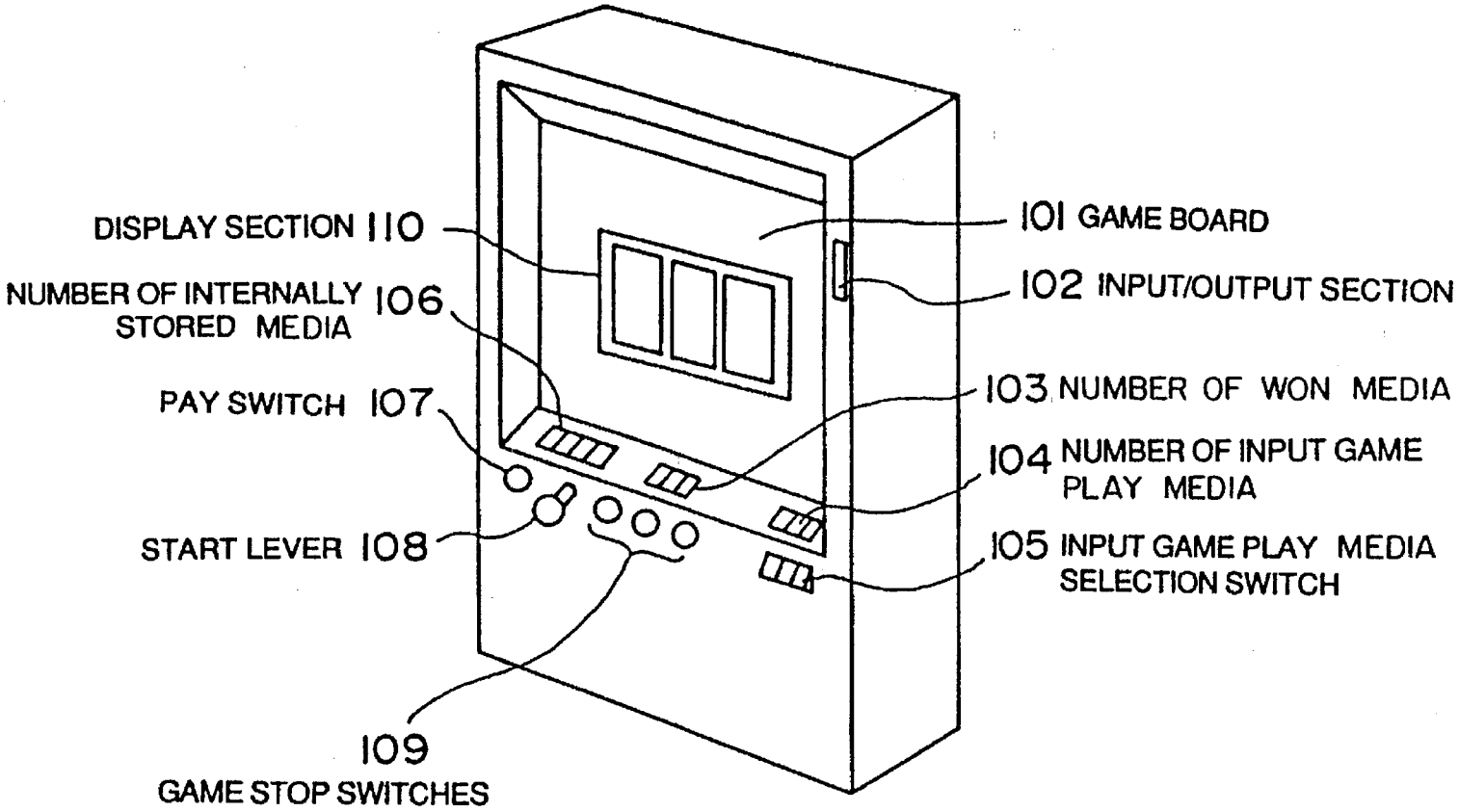
FIG. 1 is an external view A of a slot machine comprising a display unit.
Figure 2:
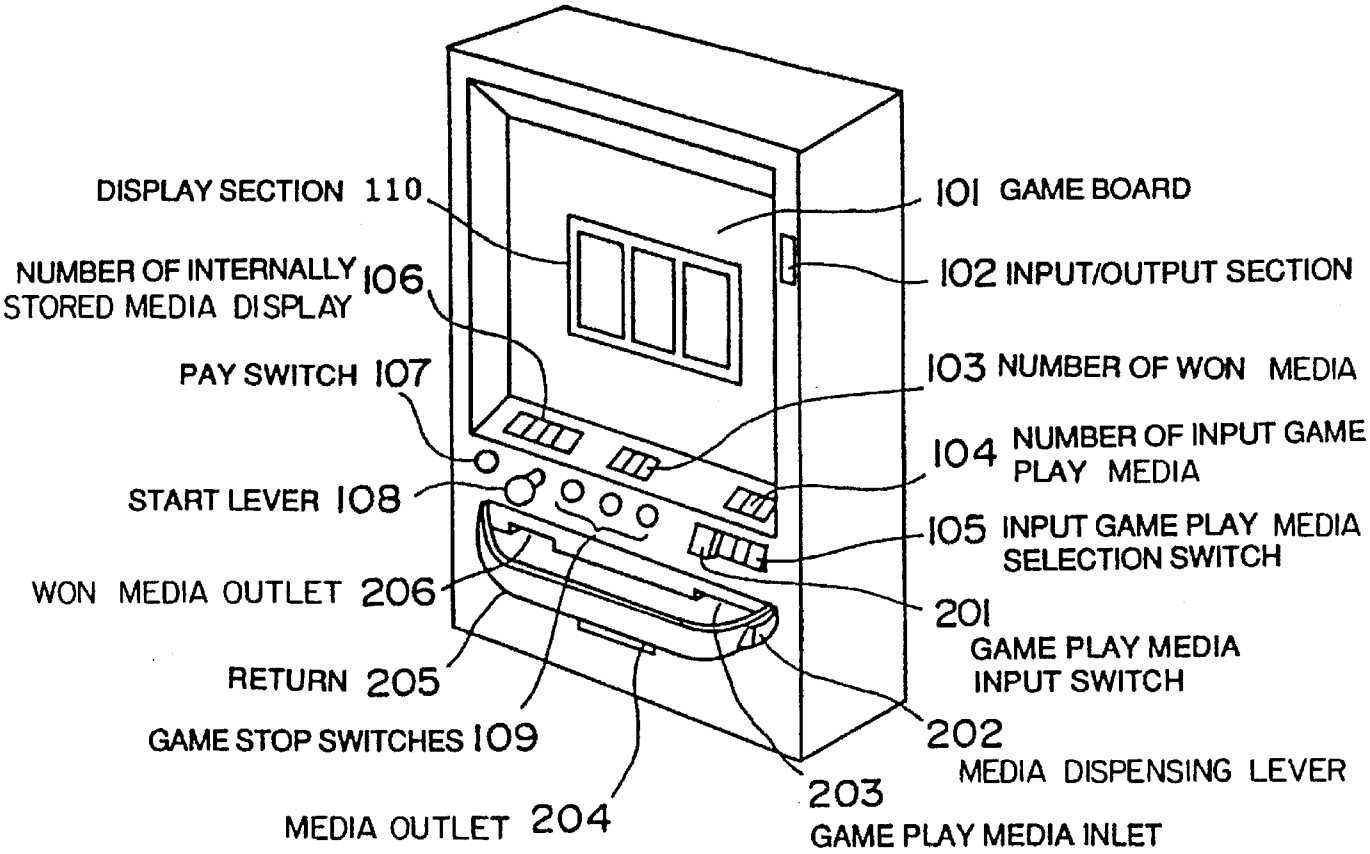
FIG. 2 is an external view B of a slot machine comprising a display unit.

FIGS. 1 and 2 are external views A and B of the embodiment, wherein a display section 110 can be placed on a game board 101. The display section 110 is display means such as a display or liquid crystal for displaying various symbols on the slot machine. A plurality of symbol columns are displayed on the display section 110 as on conventional rotation drums; The symbols can be moved or changed in display sequence, as if they actually rotated. The display section 110 may comprise display means provided for each column. A winning symbol combination line may be displayed during the game, or when a symbol combination completes a predetermined symbol combination, a message or the like indicating the event may be displayed. An input/output section 102 is provided to input/output game play media such as medals used with normal slot machines, bills, coins, or a card recording the amount of money, the number of medals, etc. Number of won media, 103, is display means for displaying the number of game play media or the winning count such as the amount of money paid out for the winning game play when the slot machine symbols match predetermined symbols. Number of input game play media, 104, is display means for displaying the number of game play media, the amount of money, or the like input through the input/output section 102. An input game play media selection switch 105 is an indication switch for indicating the number of game play media or the amount of money to be bet. For example, the player can use the switch to indicate a winning combination to be set in response to the number of medals. Number of internally stored media, 106, is display means for displaying the number of game play media, the amount of money, or the like stored in the slot machine when the number of won game play media is not output. A pay switch 107 is a switch for instructing the slot machine to pay out the game play media stored in the slot machine at the end of the game. For example, when the player presses the pay switch 107, as many game play media as stored in the slot machine can be paid out to the player or if the player uses a card, the number of game play media stored in the slot machine can be recorded on the card and the card can be dispensed. A start lever 108 is instruction means for accepting an instruction to start symbol rotation display in the slot machine. Game stop switches 109, which are provided in a one-to-one correspondence, with the columns, are instruction means for accepting game stop instructions. When a game stop instruction is accepted from the game stop switches 109, changing of the symbols is stopped at predetermined stop timings. It may be stopped automatically after a lapse of a predetermined time from the start of rotation display, without providing the game stop switches 109.

To further use medals or balls as game play media, the slot machine may further include a game play media input switch 201, a media dispensing lever 202, a game play media inlet 203, a media outlet 204, a tray 205, and a won media outlet 206, as shown in external view B of FIG. 2. The tray 205 is provided to receive game play media and is connected to the game play media inlet 203, the won media outlet 206, and the media outlet 204. The game play media input switch 201 is means for instructing the slot machine to input the game play media held in the tray 205 through the game play media inlet 203. The media dispensing lever 202 is means for instructing the slot machine to output game play media through the media outlet 204.

Figure 3:
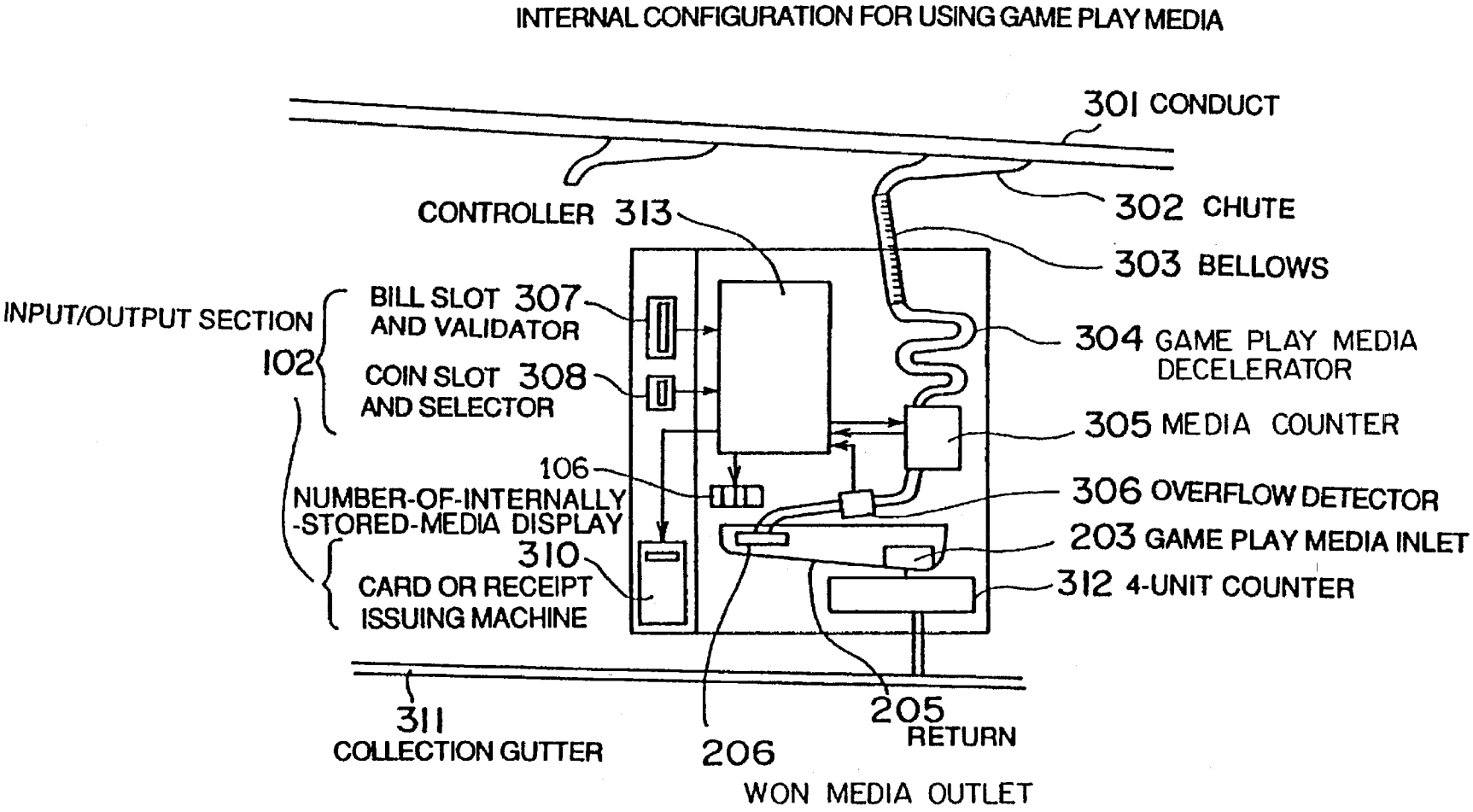
FIG. 3 is an internal block diagram showing how game play media are used.

FIG. 3 shows the internal configuration when using game play media and when the slot machine has an appearance as shown in FIG. 2. In FIG. 3, a conduct 301 is a passage for supplying game play media, which are brought via a chute 302, a bellows 303, and a game play media decelerator 304 into a game play media counter 305 for counting the number of game play media. An overflow detector 306 detects a condition in which game play media cannot be output through the won media outlet 206 because the tray 205 has become full with game play media. A 4-unit counter 312 counts the number of game play media input through the game play media inlet 203. The input/output section 102 can comprise a bill slot and validator 307, a coin slot and selector 308, and a card reader/writer 310. A controller 313 is a control section for managing input/output of game play media and controlling game plays and display on the display section 110.

When game play media are no used as shown in FIG. 1 the internal configuration of the slot machine may comprise the controller 313 and the input/output section 102 as shown in FIG. 3.

Next, the detailed internal configuration in the embodiment will be discussed with reference to FIG. 4 which is a block diagram of the configuration of a display type slot machine.

Figure 4:
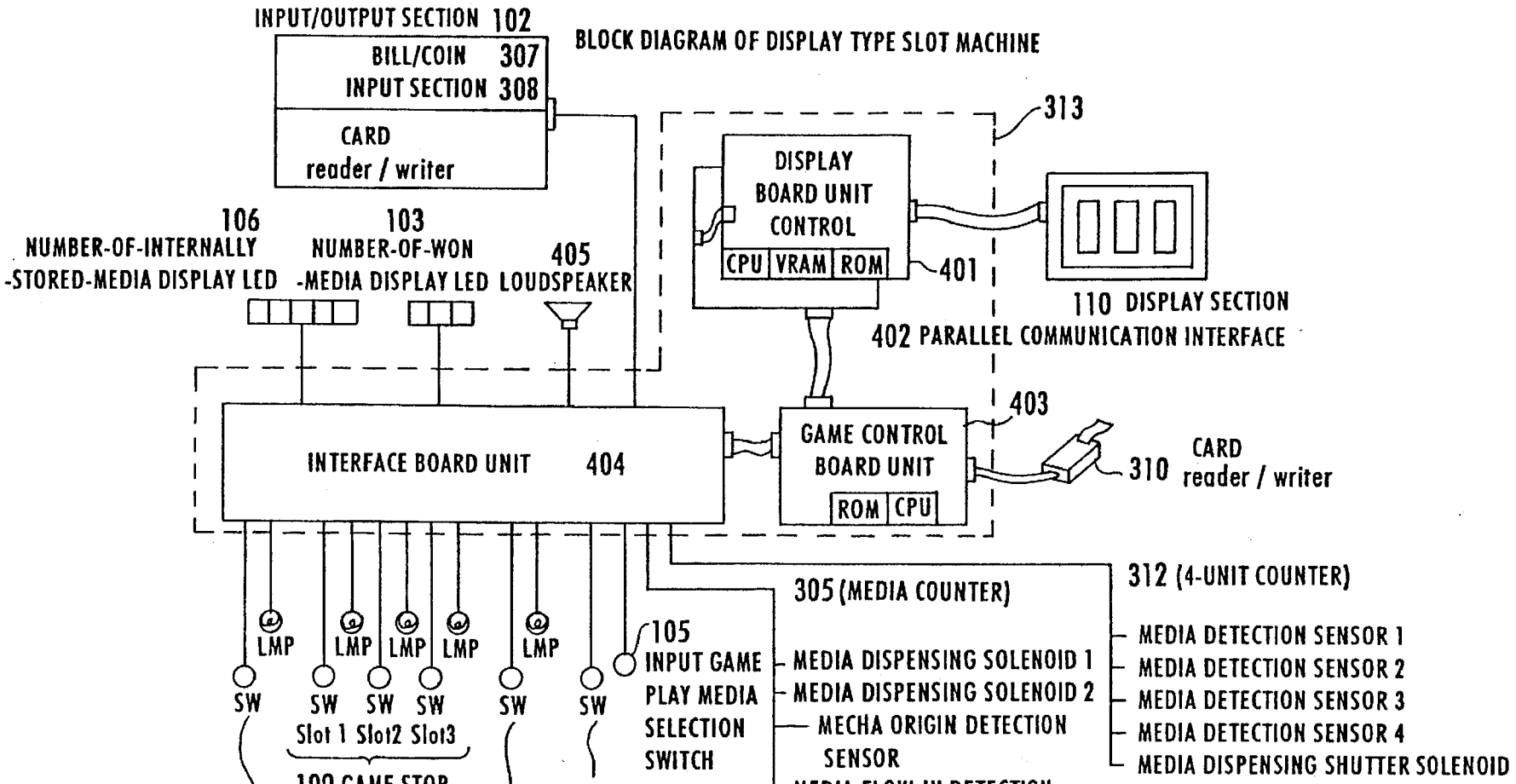
FIG. 4 is a block diagram of the configuration of a display type slot machine.

In FIG. 4, the controller 313 of the display type slot machine comprises a game control unit 403 for controlling game progress, a display control unit 401 for simulating rotation, and an interface board unit 404. In the figure, the game control unit 403 and the display control unit 401 each have a CPU as independent units.

Figure 18:
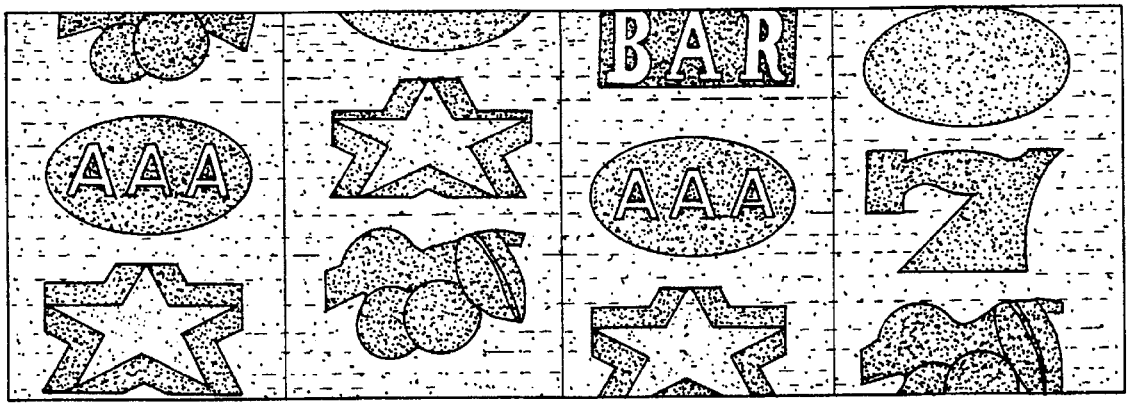
FIG. 18 is a still picture pattern illustration.
Figure 19:
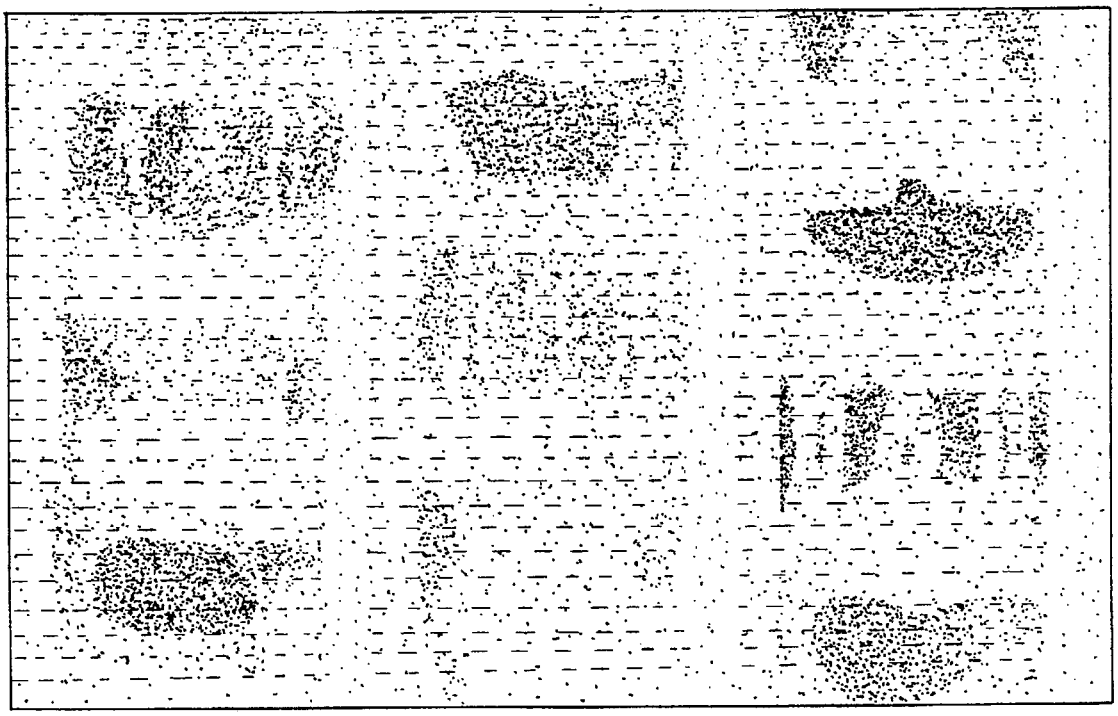
FIG. 19 is a flow condition pattern illustration during the rotation operation.

During the system operation, the game control unit 403 plays a main role in controlling game progress in accordance with programs stored in a ROM (read-only memory). It transmits display window rotation and stop instructions to the display control unit 401 via a parallel communication interface 402 for game progress. When the display windows stop, the game control unit 403 determines whether the combination of symbols displayed at predetermined positions on the display means matches a predetermined symbol combination. To display various symbols as if they had rotated, the display control unit 401 comprises a ROM storing various symbol patterns and a VRAM (video random access memory) storing background pictures for changing display of the symbols on the display window. A plurality of slot display operation modes, such as stop, acceleration, constant speed rotation, and deceleration modes, are provided, and their symbol data is transmitted to a display section 110 in frame span units. The symbol patterns stored in the ROM are provided corresponding to still picture patterns in the stop mode, the acceleration mode, and the deceleration mode and flow condition patterns showing an apparently flowing condition in the symbol pattern moving state to provide display like a dynamic image in the constant speed rotation mode. The ROM may be detachable or an erasable and programmable read-only memory (EPROM) or an electrically erasable and programmable read-only memory (EEPROM), may be used as the ROM. Normal still pictures, for example, as shown in FIG. 18, are stored as the still picture patterns and symbol patterns, like symbols flowing as if actual mechanical display windows had rotated, as shown in FIG. 19, are stored as the flow condition patterns for the rotation operation. The display control unit 401 changes symbol pattern read between the static picture and flow condition patterns stored in the ROM in response to the display operation mode. The display section 110 superimposes the symbol pattern in each display mode on a background picture stored in the VRAM for display. The interface board unit 404 connects the input/output section 102, indication and instruction switches, display means, etc., and is controlled by the game control unit 403. The indication and instruction switches include at least a start lever of the start instruction means, for accepting a game start instruction and sending a game start instruction to the display control unit 401 so as to change symbol display for each column, and stop instruction means for accepting a game stop instruction to stop symbol change for each column and sending a stop instruction to the display control unit 401. The slot machine may further include a loudspeaker 405 for outputting a sound when symbols are completed, etc.

As shown in FIG. 4, the embodiment replaces parts such as a pulse motor drive, pulse motor, drums, and a pulse motor position detector in conventional mechanical slot machines, with the display unit.

Figure 8:
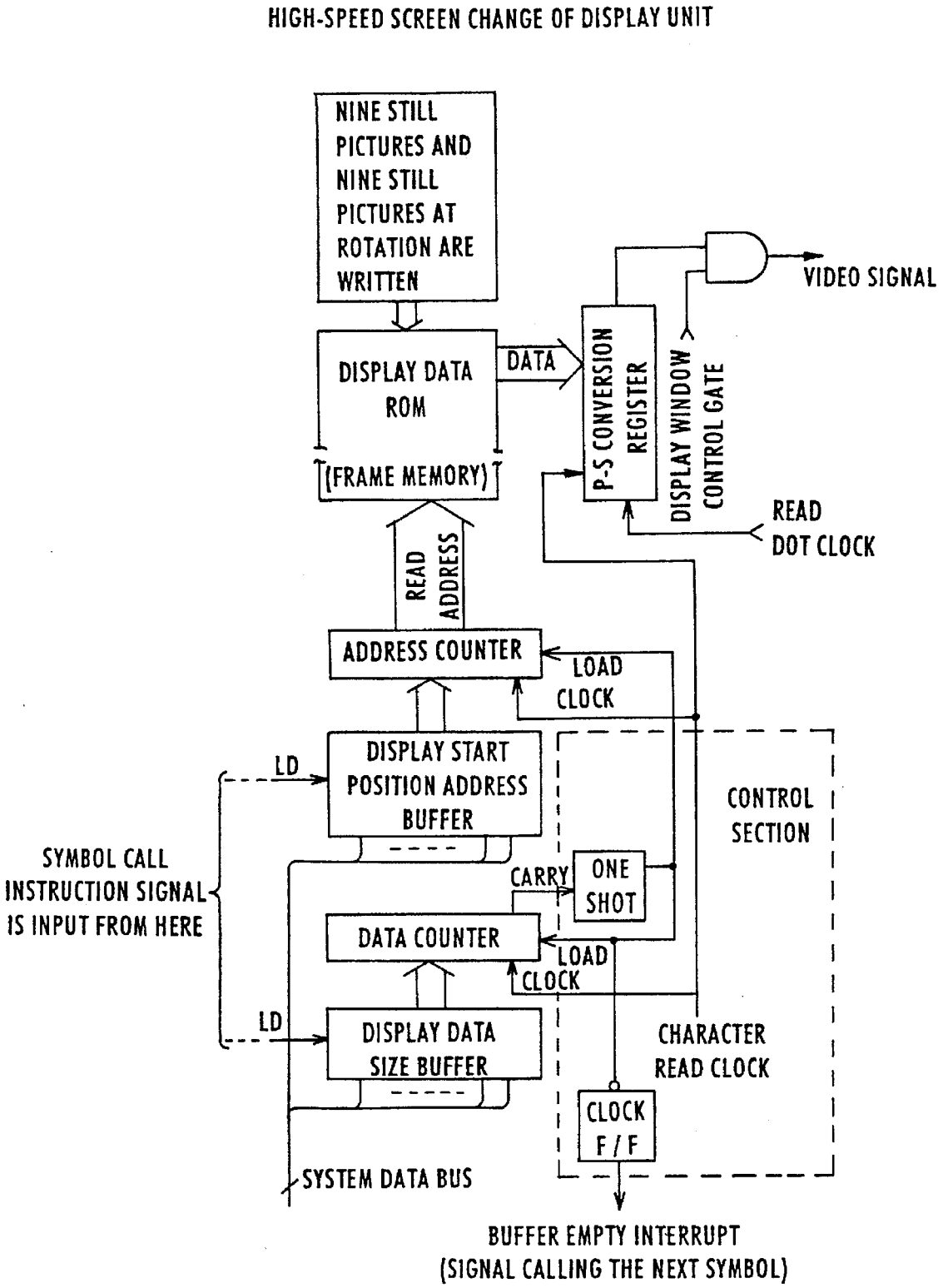
FIG. 8 is an illustration of high-speed screen change of a display unit.

Next, the configuration of the display control unit 401 will be discussed with reference to FIG. 8. The display control unit 401 comprises VRAM storing background pictures, ROM storing display data of slot machine symbols, and address generation means for changing screens at high speed. The functions of the parts in FIG. 8 are described below:

1 All symbol data to be displayed is stored in the display data ROM. Information as to which symbol starts at which address of the ROM is stored as a pattern register in a system memory.

2 The address counter section, which is a counter for reading the display data ROM contents, counts up or down in sequence according to a character read clock.

3 The display start position address buffer is a buffer for storing the read start address of the next symbol to be displayed. Upon completion of display of the preceding symbol, data is loaded into the address counter section.

4 The data counter, which is a counter for checking what byte (or word) of the display symbol is to be displayed, counts down according to a character read clock. When it reaches 0, new data is loaded.

5 The display data size buffer is a buffer for storing data defining the number of bytes (or words) of the next symbol to be displayed. When the data counter reaches 0, the buffer contents are read into the data counter.

The address generation means comprises, address counter section, display start position address buffer, data counter, and display data size buffer mentioned in the above sections 2, 3, 4, and 5, respectively.

Next, the operation in FIG. 8 will be discussed.

1) The main routine in the display control unit consults a symbol data reference table, generates the <display start position address> and the <display data size> of the symbol to be displayed as a 1-frame table, and passes the table to a buffer empty interrupt routine.

2) The buffer empty interrupt routine then loads the first address data and first data size data into the address counter and the data counter respectively at the Vsy timing based on the passed table, loads the second data into the buffers, and waits for a buffer empty interrupt. In response to a buffer empty interrupt, the buffer empty interrupt routine loads the third and later data in sequence.

3) In the current frame, the main routine generates a table of data to be displayed in the next frame.

Thus, addresses are generated by the address generation means and symbol data of the slots is read from CG-ROM. In the display control unit, display symbol data is stored in the display data ROM corresponding to a frame memory and further, still picture symbol data and still picture symbol data at the rotation time are stored, whereby when several tens of symbol patterns are changed and displayed for each frame span, even if a slow CPU such as a Z80 is used, a memory-to-memory move of display screen data is eliminated. Therefore, the CPU load is relieved and even a slow CPU can be used. The display control unit will be discussed later in detail with reference to FIG. 9.

Figure 17:
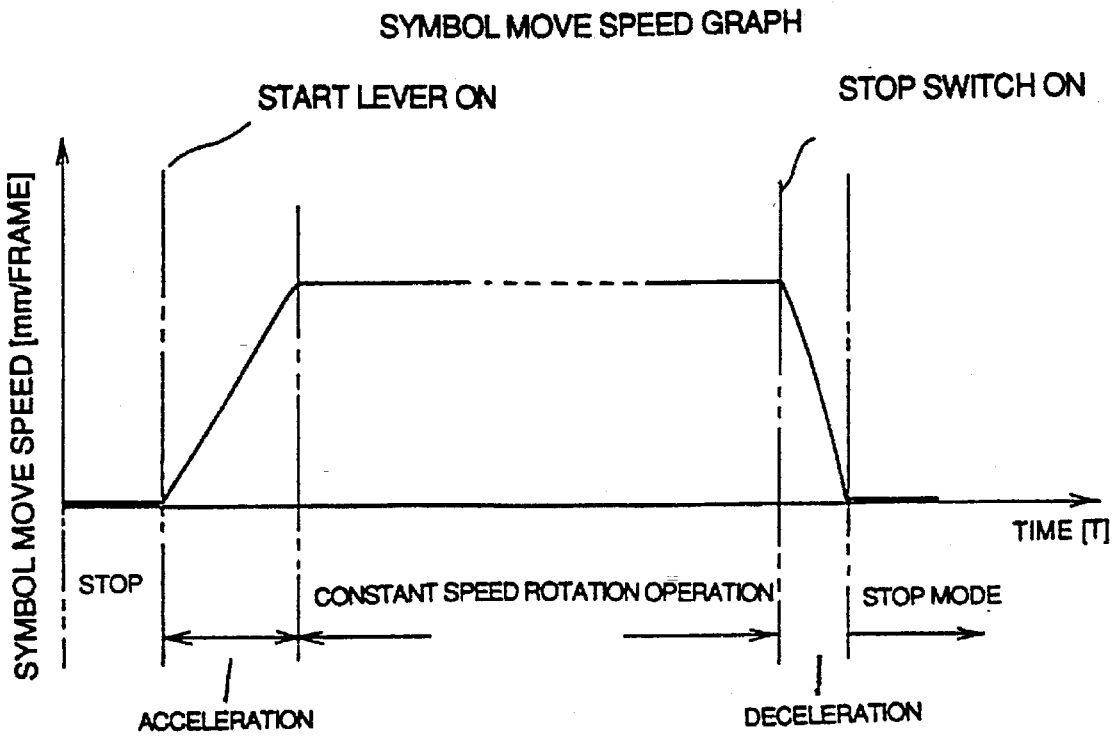
FIG. 17 is a symbol movement speed graph.

Next, FIG. 17 is a symbol movement speed graph in the display stop mode, acceleration mode, constant speed rotation operation mode, and deceleration mode, wherein the horizontal axis denotes time and the vertical axis denotes symbol movement speed (mm/frame). In the stop mode, no symbols move and the same symbol is updated every frame. When the start lever 108 is operated and a rotation display start instruction is accepted, the display windows make the transition to the acceleration mode, and the speed is accelerated until a predetermined symbol movement speed is reached. When the predetermined symbol movement speed is reached (or the given time has elapsed), the transition to the constant speed mode is made. When the game stop switches 109 are pressed (or the given time has elapsed), deceleration is made at a predetermined deceleration speed for each slot corresponding to each stop switch. When a predetermined symbol move speed is reached (or the given time has elapsed), the stop mode is entered. To display symbols so that they move at the speeds as shown in FIG. 17, the display control unit 401 comprises address generation means for generating the read top position and read amount of each of the symbols displayed at the top stage, second stage, third stage, etc., for each mode. In the embodiment, the symbol read top positions and read amounts for each mode are stored in storage means in relation to frames.

Figure 9:
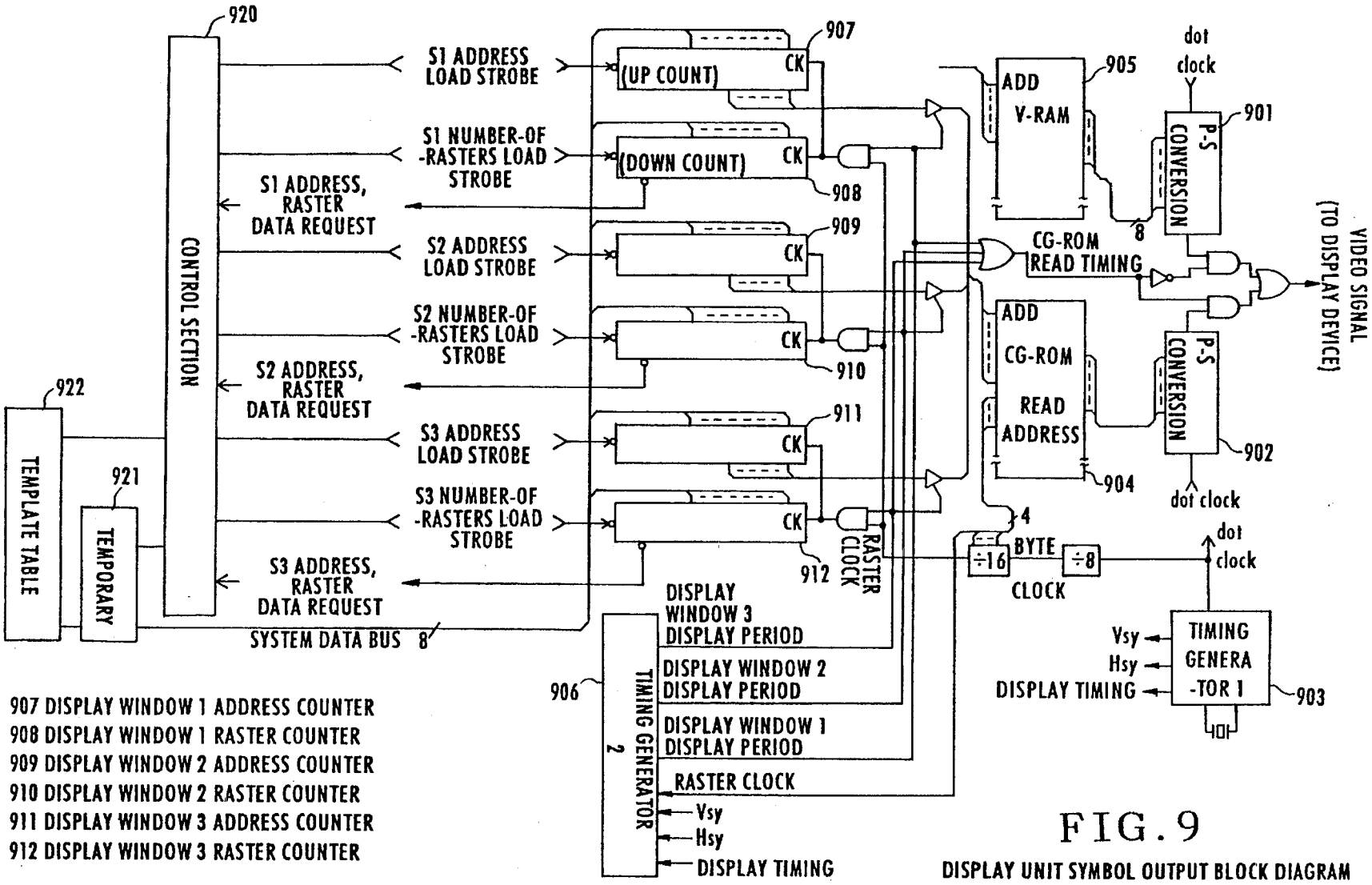
FIG. 9 is a symbol output block diagram of the display unit.
Figure 10:
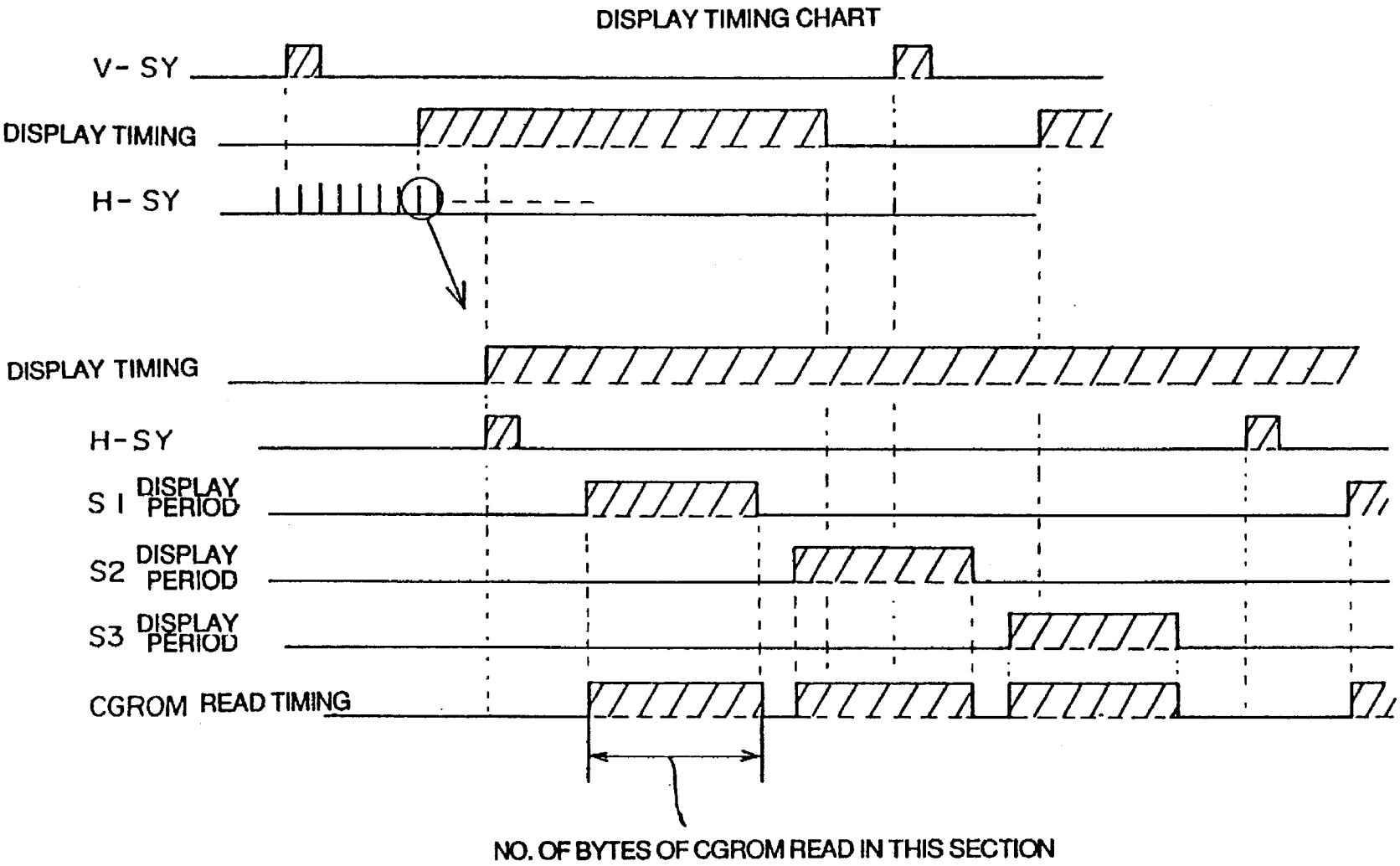
FIG. 10 is a display timing chart.
Figure 11:
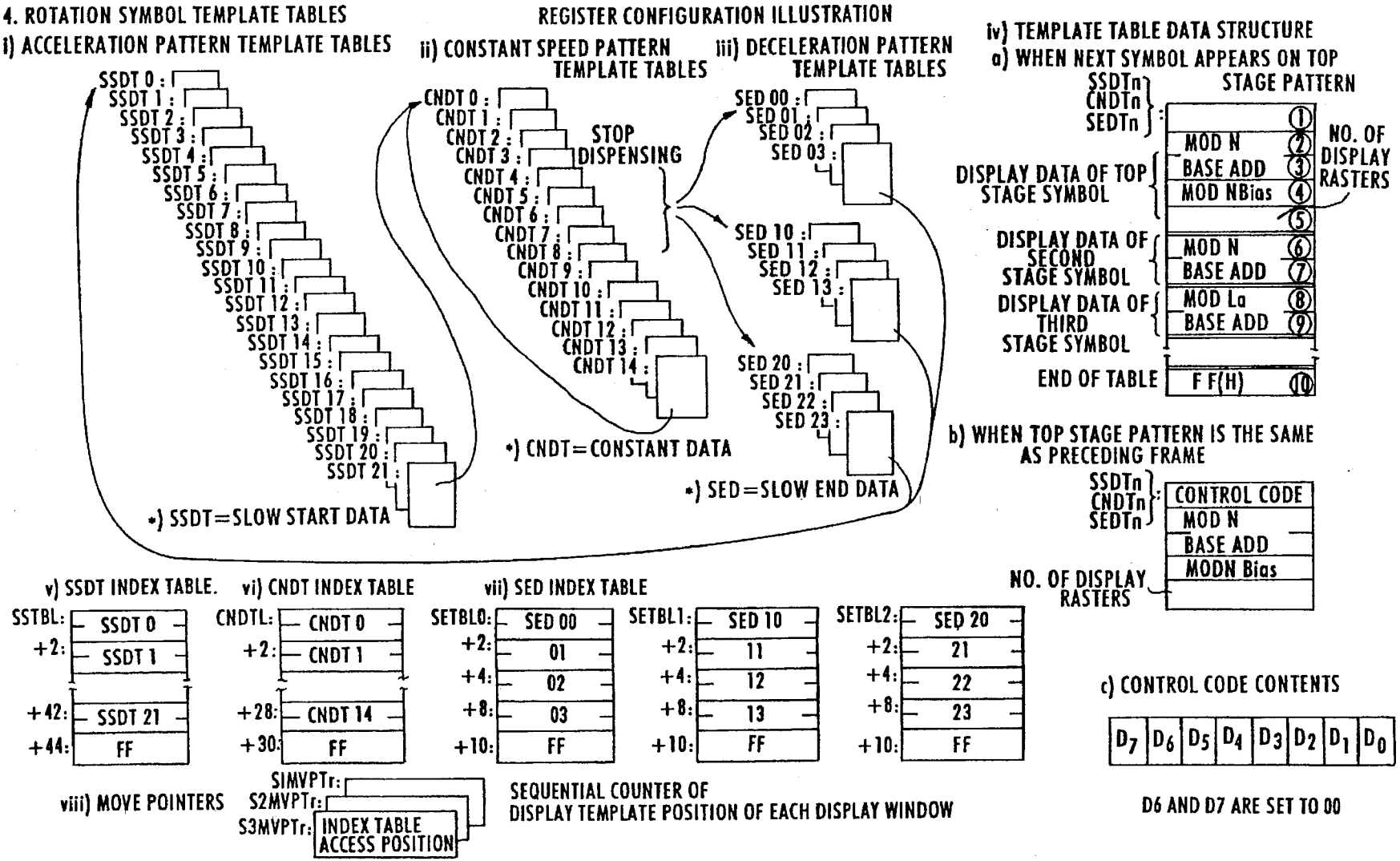
FIG. 11 is a register configuration illustration.
Figure 12:
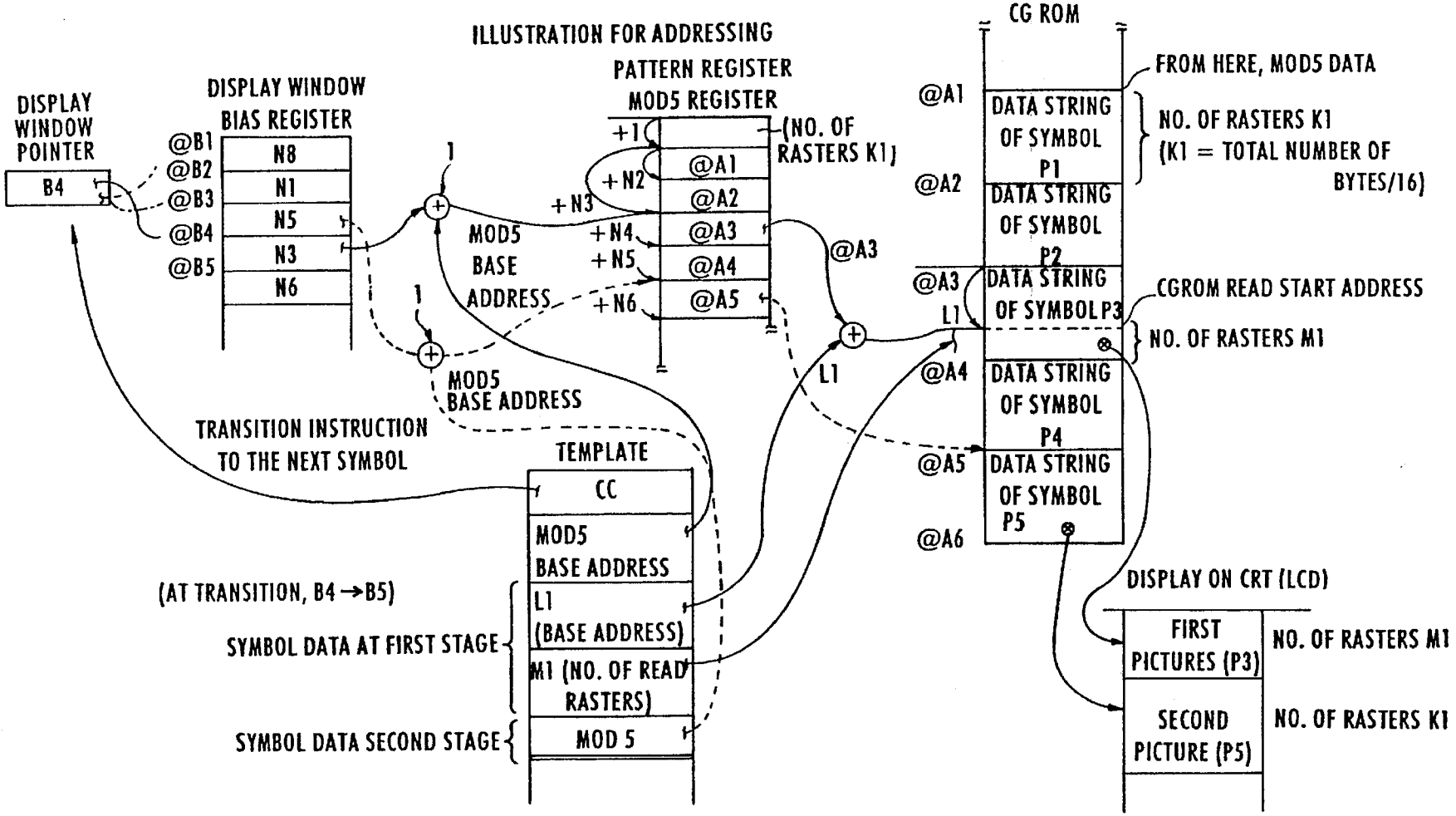
FIG. 12 is an illustration for addressing.

The display control operation in the display control unit 401 will be discussed with reference to FIGS. 9 to 12. FIG. 9 is a block diagram showing symbol output of the display control unit 401. FIG. 10 is a display timing chart. FIG. 11 is a register configuration illustration. FIG. 12 is an illustration showing addressing.

In the display control unit 401, still picture and flow condition patterns are stored in the CG-ROM for each symbol as described above, and the CG-ROM is addressed to read and display the symbols. Assume that the display section 110 displays for each display window column and displays predetermined areas as the display areas of the column, for example, it displays about four symbols at the same time. The display section 110 updates display in a frame span of a given interval of 1/60 or 1/30 sec (V-sync period); and line scanning is performed for each frame. The display control unit 401 reads the symbols to be displayed in the display areas of the columns for each frame, and in the stop mode, displays the same symbols. During the rotation operation, it moves the display positions of the symbols displayed in the display areas of the columns. That is, when reading the symbols from the ROM, the display control unit 401 shifts the read top position by a movement distance for each frame to read the symbols to be displayed within the display area range, and displays the symbols as if they had rotated by reading the symbols in a predetermined order. Further, in the embodiment, the movement distance is changed in the acceleration mode, constant speed mode, and deceleration mode. In the acceleration mode, a change is made from still picture pattern read to flow condition pattern read.

Figure 13:
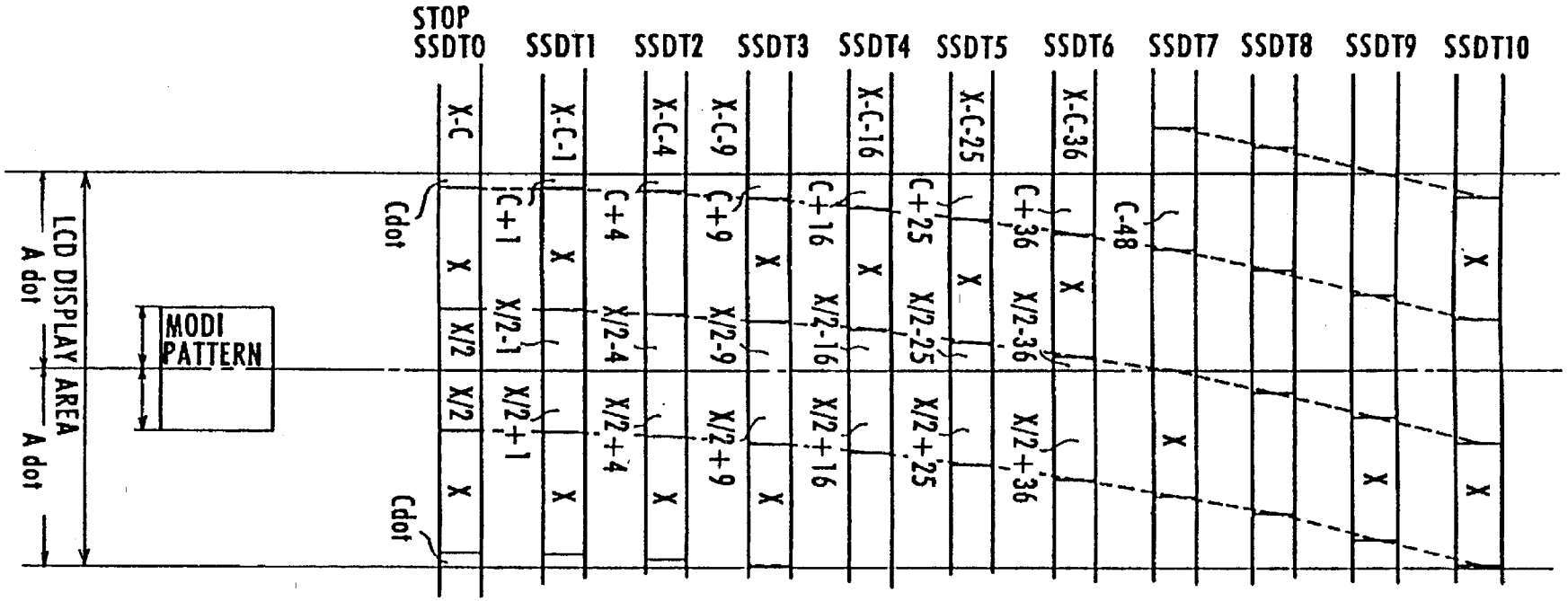
FIG. 13 is an acceleration pattern data configuration diagram.
Figure 14:
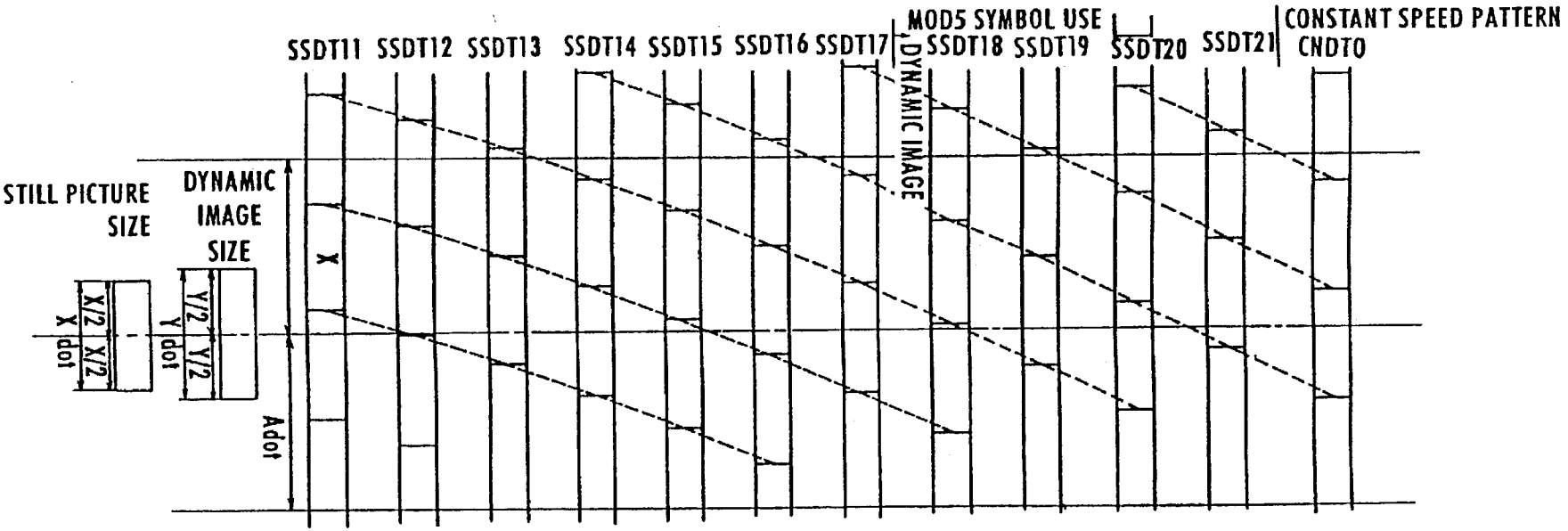
FIG. 14 is an acceleration pattern data configuration diagram.
Figure 15:
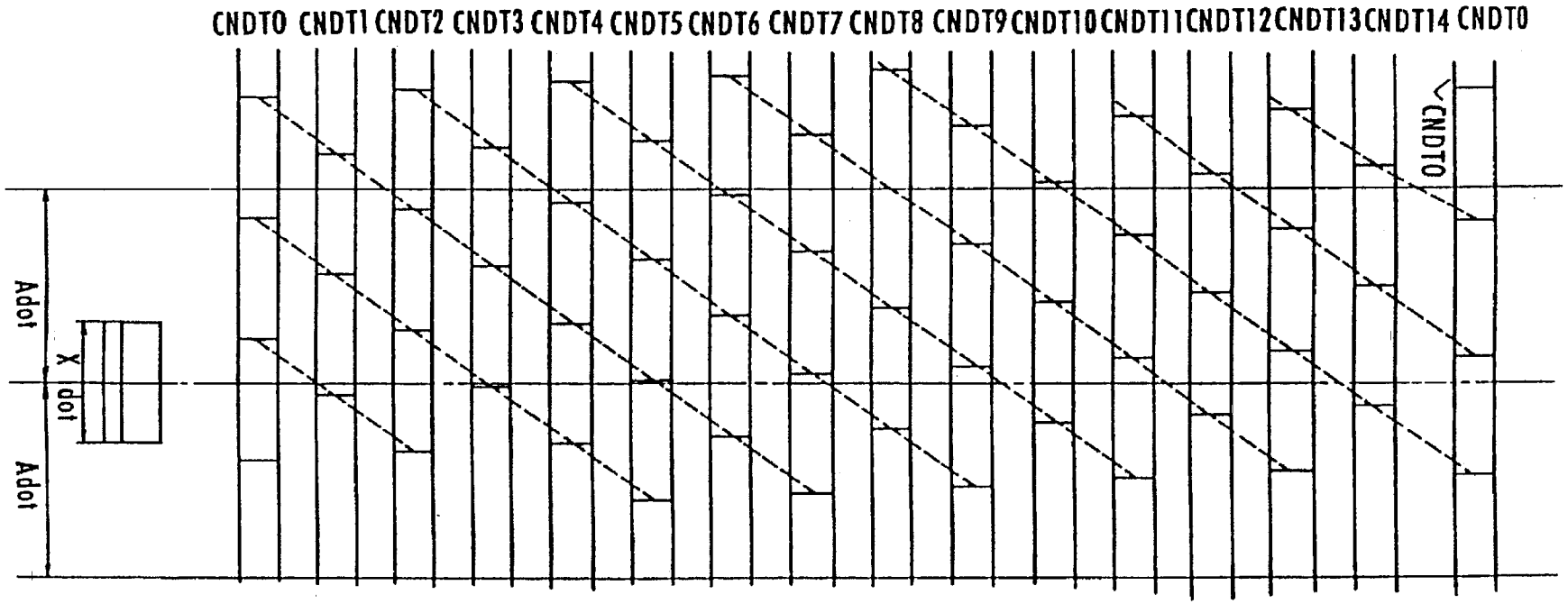
FIG. 15 is a constant speed pattern data configuration diagram.
Figure 16:
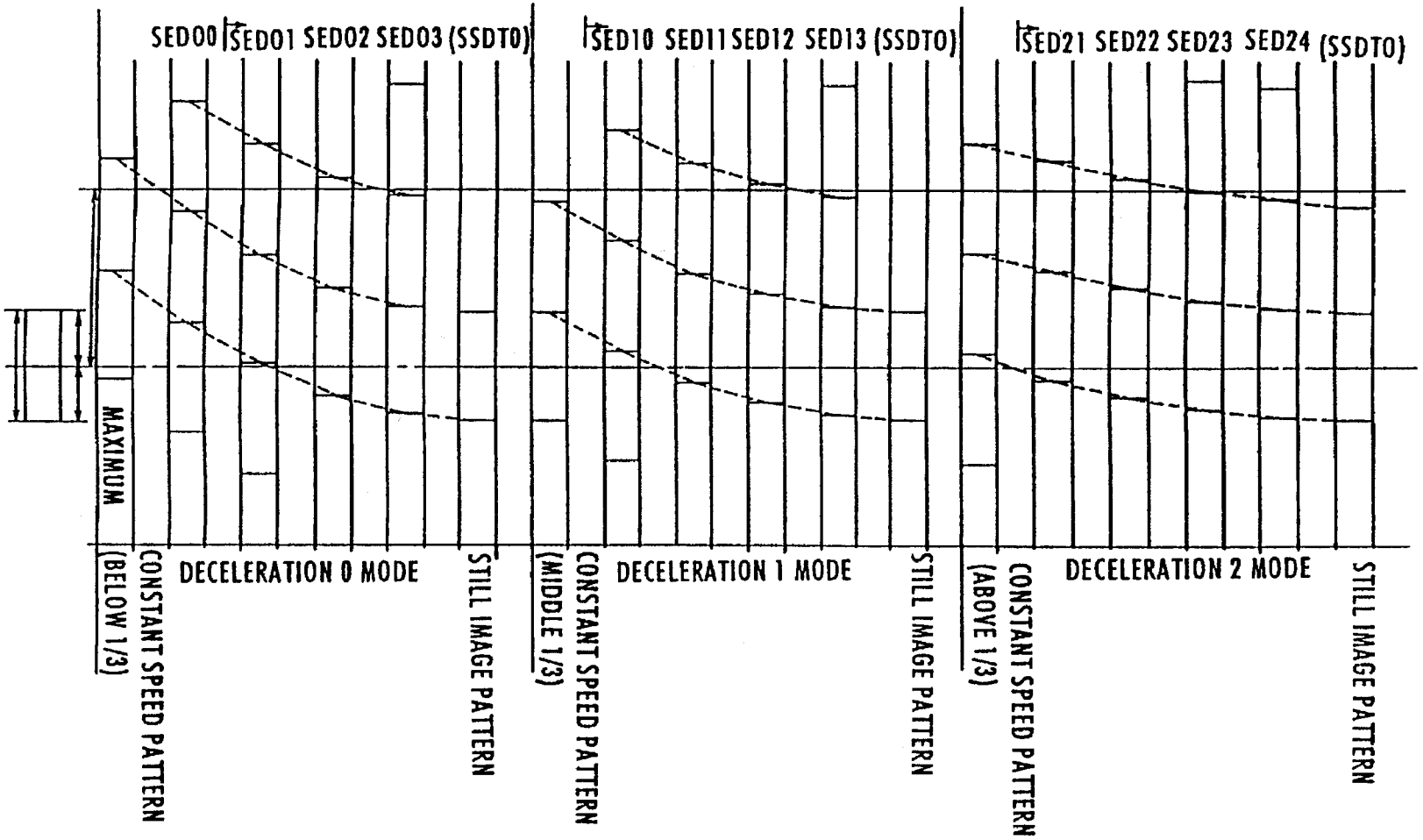
FIG. 16 is a deceleration pattern data configuration diagram.

Before the detailed operation of the display control unit 401 is discussed, the movement distance change will be described with reference to FIGS. 13 to 16. FIG. 13 shows the acceleration mode data configuration. FIG. 14 shows the acceleration mode data configuration when the screen is changed. FIG. 15 shows the constant speed mode data configuration. FIG. 16 shows the deceleration mode data configuration.

In FIGS. 13 to 16, assume that the vertical size of the display area of the display section 110 is (A+A) dots and that the vertical size of each symbol is X dots. In FIGS. 13 and 14, SSDT0–SSDT21 indicate the display positions of each symbol in frames in the acceleration mode. The symbols are shifted by a predetermined movement distance for each frame for display. Each frame displays the symbol at the top stage, that at the second stage, that at the third stage, that at the fourth stage, etc., on the screen. SSDT0–SSDT21 are template tables corresponding to the frames and store at least the read top positions and read amounts from the top stage to the bottom stage. In FIG. 15, CNDT0–CNDT14 tables are provided for the constant speed mode; symbols are repeatedly displayed until a stop instruction is issued. In FIG. 16, SED00–SEDO3 tables are provided for the deceleration mode and finally the transition to the stop mode is made. As shown in FIG. 16, a plurality of deceleration modes may be provided. For example, one of the deceleration modes may be selected according to the display amount of the symbol at the top stage displayed when a stop instruction is given. In the embodiment, a change is made from still picture pattern to flow condition pattern when SSDT18 for the acceleration mode is applied.

FIG. 11 (iv) shows a data structure example of the template tables, wherein 1 denotes a control code which is a flag byte indicating which of a new symbol pattern and the same symbol pattern is to be displayed for the preceding display frame. For example, a code indicating whether or not the symbol at the top stage changes, a code indicating whether or not the symbol mode changes, a code indicating selection of the deceleration mode when a stop instruction is given in the next frame, a code indicating the current mode, etc., can be preset. 2 denotes identification information of the display pattern (still image pattern or flow condition pattern) read for the symbol at the top stage. 3 is a base address indicating the top position of the display pattern in the ROM. 4 is a bias value indicating the number of rasters from the top to the display start position for indicating at which position of the symbol the symbol display is started, whereby the ROM read top position can be determined. 5 denotes the total number of display rasters. 6 and 7 denote symbol display data at the second stage and 8 and 9 denote symbol display data at the third stage.

Next, the template processing procedure will be discussed with reference to FIG. 11.

In FIG. 11, movement pointers are provided for indicating the template table positions. Each movement pointer can be provided by a counter indicating the display template position of each slot and counting the Vsy signal in sequence. The data read from a template table is temporarily stored in a temporary work area.

(1) When the slot machine power is turned on, the display control unit reads template SSDT0 (stop mode) repeatedly.

(2) Upon receipt of a rotation request from the game side, the template is changed to SSDT1 and template SSDT1 data is expanded. The data expanded for the next frame is written into the temporary area.

(3) Each time the frame is updated, that is, each time a Vsy interrupt arrives, the template is changed to SSDT2, SSDT3, . . . This step is repeated.

(4) When the acceleration template processing terminates, constant speed template processing is started and performed in a similar manner to the above by repeatedly making a loop of CNDT14→CNDT0.

(5) Upon receipt of a display window stop instruction from the game side, the template is changed to rotation stop templates, which are expanded in sequence. When the stop template SSDT0 is reached, the display window is stopped.

(6) The template processing is performed separately for each of display windows 1 to 3.

Next, CG-ROM addressing will be discussed with reference to FIG. 12.

In FIG. 12, display symbol data is stored in the CG-ROM and when the ROM is accessed, the data is directly output onto the CRT (or LCD) as video data. Therefore, this eliminates the need for temporarily transferring symbol data to the VRAM for reading the data as video signal. Several pattern registers (tables) are provided according to symbol patterns and they store information for each symbol data. The patterns are pattern symbol description variations like still picture and flow condition patterns, as described above.

Each pattern register contains:

(a) the number of rasters of 1-symbol data in the mode (number of rasters=total number of bytes of one symbol÷16); and (b) actual location addresses of symbols, such as seven, BAR orange, cherry, etc., in the mode in the CG-ROM, in the form of a table.

In FIG. 12, display window bias registers (tables) are provided in a one-to-one correspondence with display windows 1 to 3; each provides display window symbol arrangement for one revolution with 1-byte codes. That is, the display window bias register stores pattern register addresses corresponding to 1-revolution symbols. The codes operate on the pattern register and are defined as bias values from pattern register base address+one for generating addresses of the ROM data to be displayed. Each display window pointer, which is a counter, serves as a pointer to the display window bias register for pointing to the current rotation point of the corresponding slot. The display window pointer is incremented as indicated by the template contents. Three display window pointers are provided corresponding to display windows 1 to 3. The templates are provided to describe symbol rotation conditions for each frame, as described above. In the embodiment, a total of 49 templates are provided as follows:

(a) stop template SSDT0

(b) acceleration templates SSDT1–SSDT21

(c) constant speed templates CNDT0–CNDT14

(d) deceleration templates SED00–SED03 SED10-SED13 SED20-SED23

The data structure in each template is as shown in FIG. 11 (iv) above. The templates are called in sequence for each frame and indicate the CGROM read top address, the total number of read bytes, etc., for display.

In FIG. 12, the display control unit expands template data read in synchronization with Vsy for generating ROM read addresses as follows:

(a) Whether or not the display window pointer is to be incremented is determined according to the control code in the template indicating whether or not a new symbol pattern is to be displayed for the preceding display frame. That is, if the control code indicates display of a new symbol pattern, the display window pointer is incremented to rotate the display window to the next symbol. For example, in FIG. 13, the next symbol appears within the display screen from above, with the SSDT10 template. In this case, the display window pointer is incremented and the pointer to the display bias register is incremented so that the contents of the display window register indicates the pattern register address of the next symbol.

(b) The ROM area actual location address stored in the pattern register is accessed according to the display window bias register contents pointed to by the display window pointer, the base address of the pattern register specified by the template, and the fixed value 1. For example, the pattern register address is found from the address value of the pattern register indicating the N3 symbol (the address value means indicated the distance from the top position of the display pattern register) as the display window bias register contents pointed to by the pointer, the display pattern register top position as the template base address, and the fixed value 1. The pattern register is read based on the pattern register address, and the ROM area actual location address is obtained.

(c) Next, the actual CG-ROM read address is found from the ROM area actual location address and the template base bias value. For example, since the last several bytes of symbol data are read for the first picture on the CRT, the bias value for the read is supplied from the template. The base bias read from the template is added to the ROM area actual address accessed so far to determine the final address for reading the first picture.

(d) The ROM read addresses of the second picture and later are determined on routes indicated by dotted lines in FIG. 12.

Since the symbol arrangement order of the second picture and later is determined, the ROM read addresses are inevitably determined by retracing the slot bias register in sequence. Since incomplete display like the one in the first picture is not required (all symbol data may be displayed), the K1 value written in the pattern register is drawn out for the number of read rasters without the need for base bias L1, number of read rasters M1, etc.

(e) Then, the read addresses of the third and fourth pictures are determined.

(f) The data is temporarily stored in a temporary area in the following format and is read in sequence according to an interrupt request issued from the hardware in the next frame:

Temporary:

First picture ROM read address

Number of first picture read rasters

Second picture ROM read address
Number of second picture read rasters
Third picture ROM read address
Number of third picture read rasters
Fourth picture ROM read address
Number of fourth picture read rasters
Fifth picture ROM read address
Number of fifth picture read rasters Two temporary areas A and B can be provided. While data is read from A according to an interrupt in the current frame, data required for the next frame can be provided in B. This is repeated.

Next, the hardware operation of the display control unit for reading out symbol display data from the display data storage means storing symbol display data based on the temporary area contents read as described above will be discussed with reference to FIG. 9.

In FIG. 9, P-S conversion means 901 and 902 convert parallel data into serial data. Timing generators 903 and 906 generate timings required in the display control unit. CG-ROM 904 is display data storage means for storing symbol display data. It stores various symbols of still picture and dynamic image patterns. V-RAM 905 is background picture storage means for storing background pictures. Display window 1 address counter 907 indicates the CG-ROM 904 read address for display window 1. Display window 1 raster counter 908 indicates the number of CG-ROM 904 read rasters. Display window 2 address counter 909 and display window 2 raster counter 910 indicate the CG-ROM 904 read address and the number of CG-ROM 904 read rasters for display window 2. Likewise, display window 3 address counter 911 and display window 3 raster counter 912 indicate the CG-ROM 904 read address and the number of CG-ROM 904 read rasters for display window 3. The address counters and the raster counters for display windows 1 to 3 make up address generation means 920 for generating the read top position and read amount. Data is loaded into the raster counters from temporary area 921 in which the numbers of rasters read from template table are stored. Each address counter, into which the address of the read top position is loaded from the temporary area 921, counts up according to a raster clock. When as many addresses as indicated by the corresponding raster counter are output, the address of the next display window is output. The control section 920 controls the address counters and the raster counters and issues a data load instruction in response to a data request signal from the raster counter. The display periods of the display windows are divided in a time division manner, as shown in FIG. 10. In the figure, the frame is updated each time the Vsy signal is turned on and 1-raster display data is read according to the Hsy signal.

(1) When a Vsy signal interrupt occurs, data of the ROM read address and the number of rasters of the top stage symbol provided in the temporary area is loaded into all of the address counters, the raster counters, and display windows 1–3.

(2) The address counters are incremented and the raster counters are decremented according to a raster clock in their respective display window display periods for supplying addresses to the CGROM. In the periods, CGROM data is output as video signal.

(3) When the raster counter reaches a count value 0, an interrupt occurs and the raster counter outputs a next data (data on the second picture) request signal.

(4) When receiving the data request signal from the raster counter, the control section 920 sends the ROM read address and the number of rasters of the second picture from the temporary area to the slot making the interrupt request. This step is repeated for the third picture, fourth picture, . . . etc.

(5) When the next Vsy interrupt occurs, the control section 920 performs toggle switching of the temporary area and repeats the operation starting at (1).

(6) In periods other than the CGROM read timings, data is output for display from the V-RAM. The data is output for display on the background other than the display window spaces.

Next, flow condition pattern preparation methods will be discussed.

1. A slot machine comprising conventional mechanical rotating drums is rotated and the drums are shot with an optical camera at the shutter ring of the frame span time (shutter speed of 1/60 sec). At this time, auxiliary light such as a strobe is not used and a stable light source such as natural light or an incandescent lamp is used. Of course, the image is picked up in such a form that the camera moves up and down, as shown in FIG. 19. This image is read through a scanner, etc., and is converted into digital data for making a flow condition pattern.

2. A slot machine comprising conventional mechanical rotating drums is rotated and the drums are shot with a video camera as in 1. The image signal is read for making a flow condition pattern.

3. Computer graphics (CG) software is used to prepare a flow condition pattern in the following sequence:

a. Screen contrast (brightness) is lowered and set.
b. Read still picture is moved one dot at a time by 1-frame movement distance and data for each dot are added together.
c. Lastly, the contrast is balanced and symbol data of a flow condition pattern is set.

Figure 5:
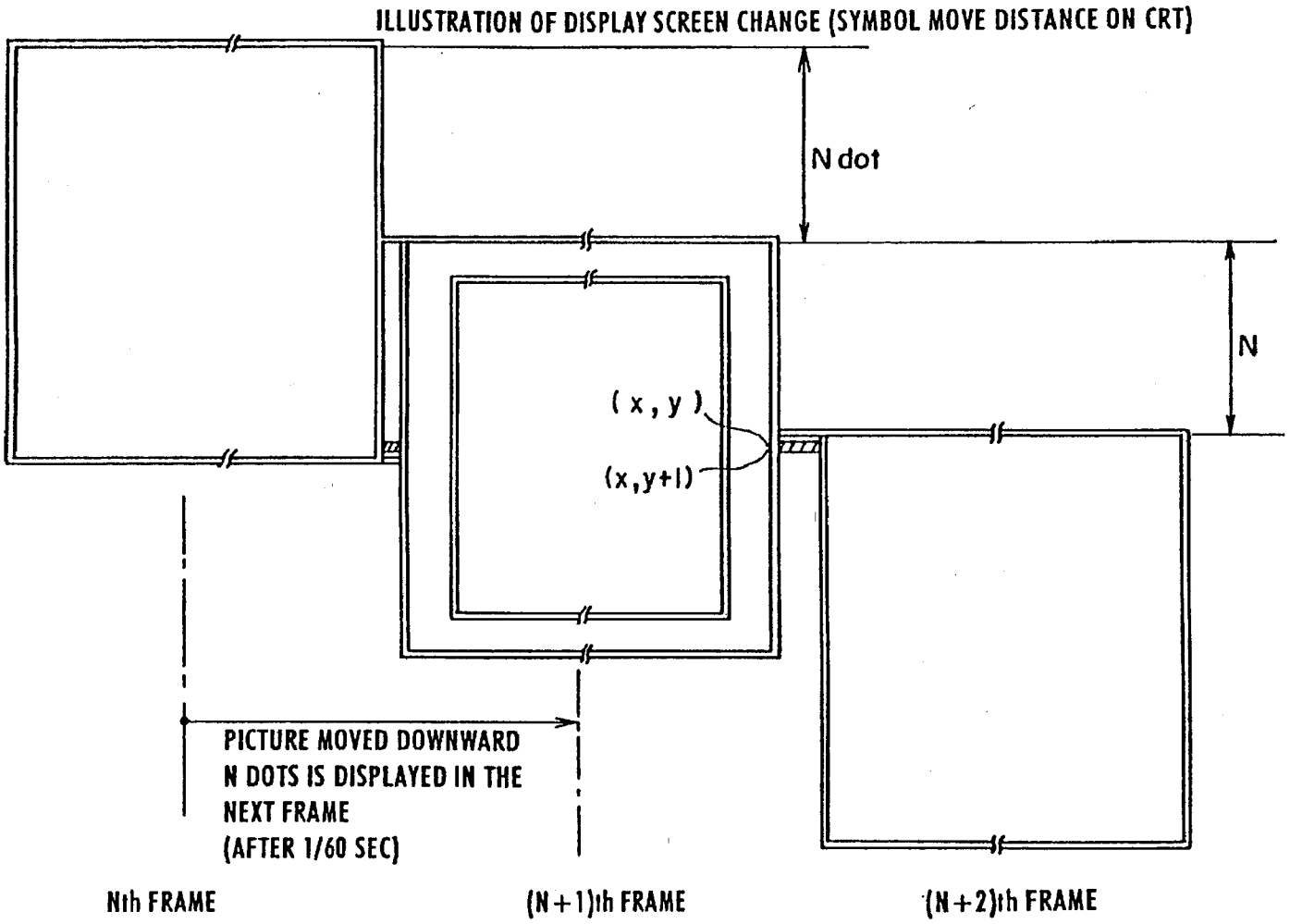
FIG. 5 is an illustration of display screen change.

FIG. 5 illustrates generally the display screen sequence that simulates the rotation of symbols as if the symbols were actually imprinted on the rotating drum. When the slot machine simulates the rotation of such a drum at a constant speed, a symbol is displayed in a video frame as having moved N dots or pixels in the direction of rotation with respect to the previous frame.

Figure 6:
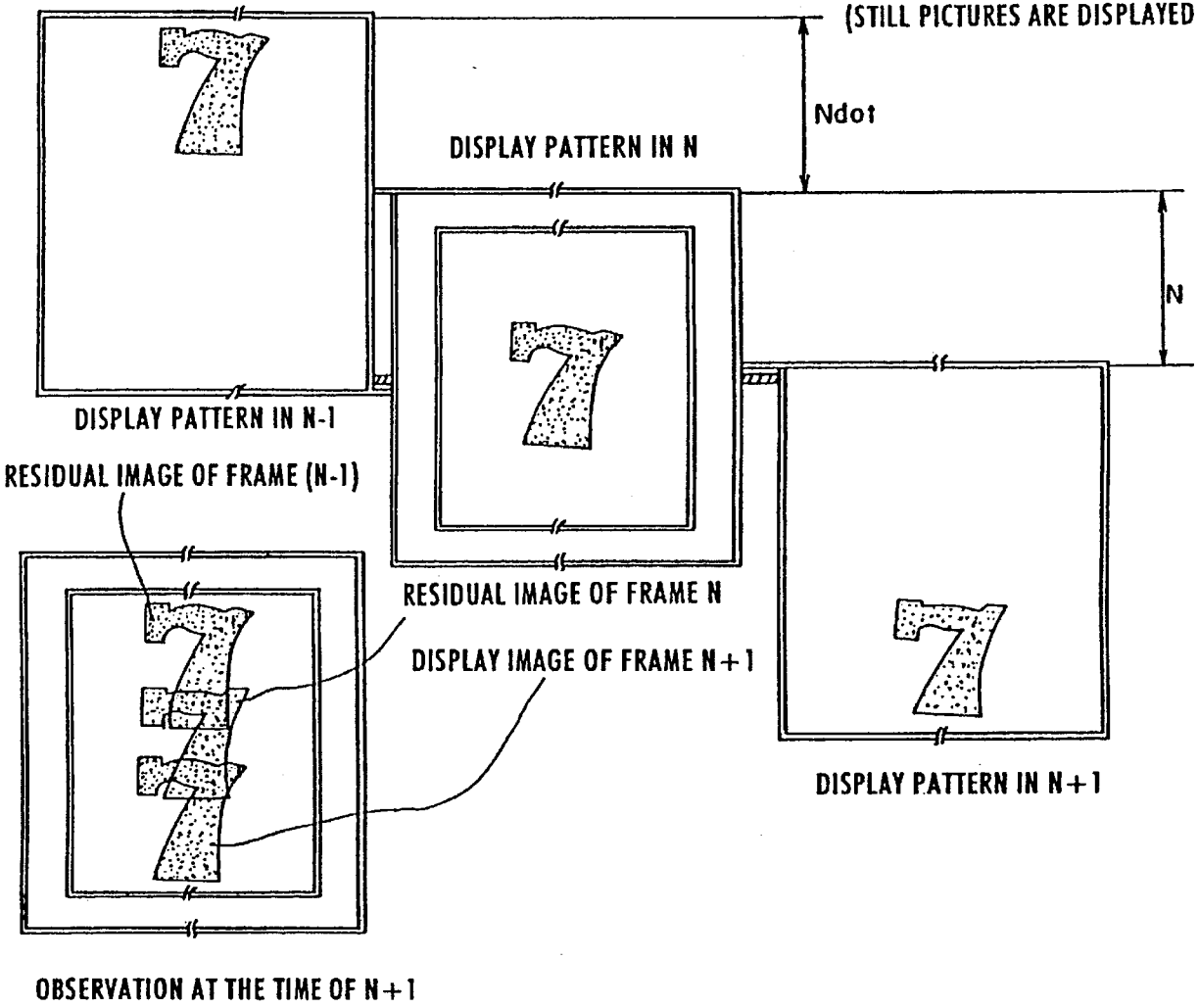
FIG. 6 is an illustration of display screen change when still pictures are used.
Figure 7:
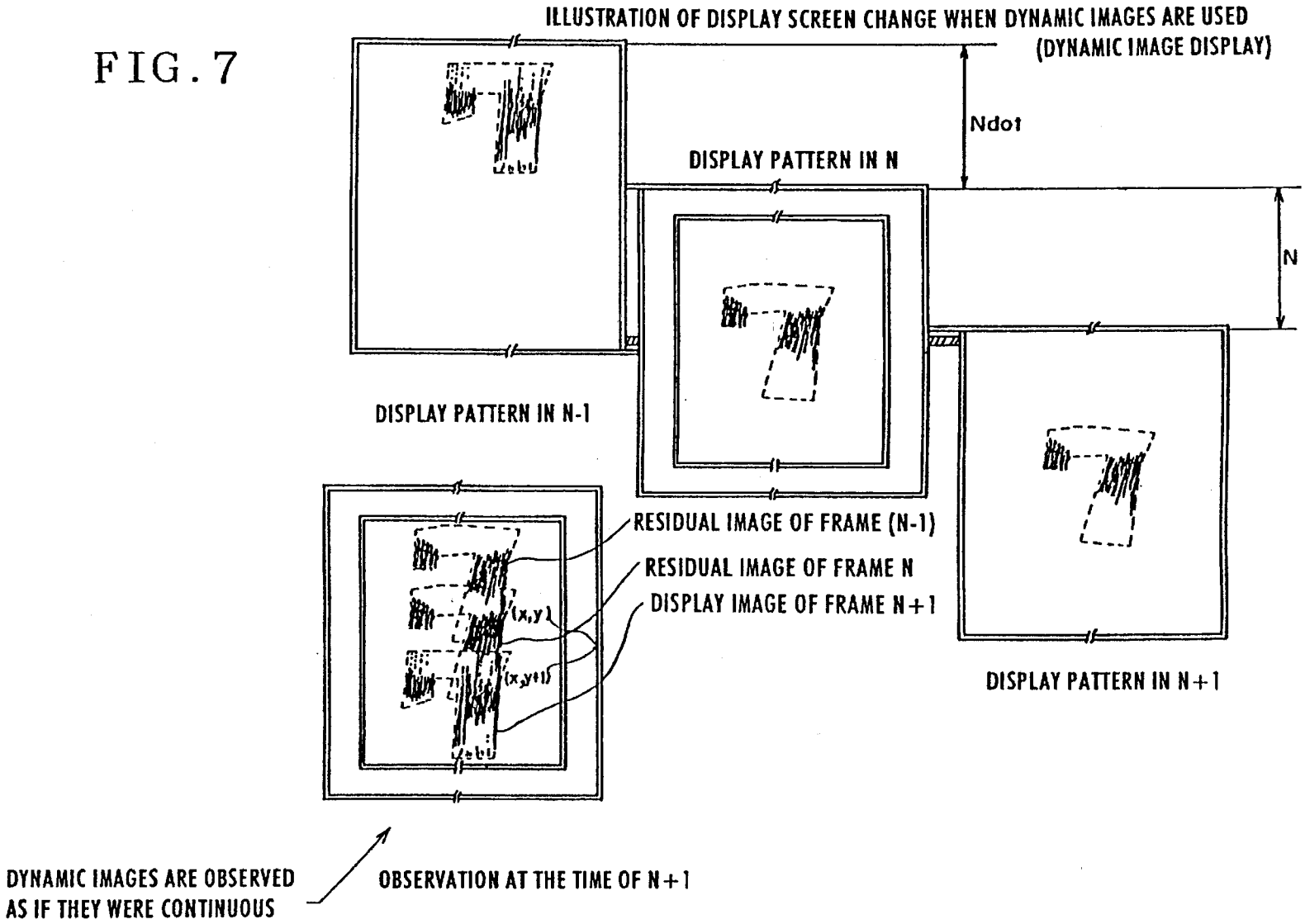
FIG. 7 is an illustration of display screen change when dynamic images are used.

The prepared flow condition pattern as described above is displayed on the display section as shown in FIG. 7, an illustration of display screen change when the flow condition pattern is used. FIG. 7 shows display patterns in frames (N−1), (N), and (N+1) and how the patterns are observed at the time of frame (N+1). The pattern in each frame is moved by N dots corresponding to the movement distance when a drum type slot machine is rotated for 1/60 or 1/30 sec. The pattern is observed as shown in FIG. 7 due to the residual image effect of human being eyes at the time of frame (N+1). In the embodiment, still picture and flow condition patterns are stored in the CG-ROM and a read is changed from the still picture pattern to the flow condition pattern at a predetermined time. When a stop instruction is given, a read can be changed from the flow condition pattern to the still picture pattern at a predetermined time. For comparison, FIG. 6 provides an illustration of display screen change when still pictures are used. FIG. 6 shows display patterns in frames (N−1), (N), and (N+1) and how the patterns are observed at the time of frame (N+1).

When the flow condition pattern is used, the player Can see the pattern as shown in "OBSERVATION AT THE TIME OF FRAME N+1" in FIG. 7 as if it were rotated on the mechanical drum of a slot machine.

Symbols moving at the frame period speed of 1/60 or 1/30 sec rather than still pictures, are provided and displayed as flow condition pattern symbols, whereby each picture is seen as it flows, thus the clearness of each picture is lost and the player can feel as if the entire drum is rotated. Although unclear display is made on the seemingly flowing screen, what each picture is can be roughly determined, thus the condition is satisfactory to experienced customers utilizing good hand to eye coordination.

By moving the symbol pattern display position, the player can feel as if actual rotation were made as compared with conventional slot machines changing symbol patterns to the same position on the display screen.

As described above, by changing the movement distance, the rotation speed rises gradually for a short time, and the rotation speed then becomes constant. When the stop switch is pressed, the rotation speed gradually slows down and the drum stops. This rotation pattern provides a more realistic motion, resembling drum rotation, of a mechanical slot machine.

The slot machine according to the invention enables the player to feel as if the entire drum has rotated, and thus it can provide dynamic and diversified interest for the players, as a slot machines using drums.

FIELD OF INDUSTRIAL APPLICATION

The invention can display symbols as they move visually when movement display faster than the frame period is executed for devices comprising a graphic display such as a CRT, LCD, or plasma display, as well as slot machines.

What is claimed is:

1. A display control method in a screen display type slot machine having a display with a display surface provided on a plane, said method comprising steps of:

storing symbol images representing a plurality of types of symbols and flow images representing flowing conditions of said symbols;

reading a first symbol image, which is one of said stored symbol images representing a first symbol in a stop mode to update an image on the display surface;

reading a first flow image representing a flowing condition of the first symbol in an acceleration mode to update the image on the display surface and thereby simulate a movement of the first symbol on a rotating drum such that the display surface virtually rotates; and executing updates of said first flow image on the display surface in the acceleration mode, wherein a first update displays said first flow image at a first location on said display surface, a second update displays said first flow image at a second location which is shifted in location from the first location on said display surface, and a third update displays said first flow image at a third location which is shifted in location from the second location on said display surface and a distance on said display surface from the first location to the second location is smaller than a distance on said display surface from the second location to the third location.

2. A display control method according to claim 1, further comprising the step of:

reading the first flow image in a constant mode to update the image on the display surface.

3. A display control method according to claim 1, further comprising the step of:

reading the first flow image in a deceleration mode to update the image on the display surface.

4. A display control method according to claim 1, further comprising the step of:

reading the first symbol image in a deceleration mode to update the image on the display surface.

5. A display control method according to claim 1, wherein the steps are performed in the recited order and the third update occurs subsequent to the second update and the second update occurs subsequent to the first update.

6. A display control method in a screen display type slot machine having a display with a display surface provided on a plane, said method comprising steps of:

storing symbol images representing a plurality of types of symbols and flow images representing flowing conditions of said symbols;

reading a first symbol image which is one of said stored symbol images representing a first symbol in a stop mode to update an image at the same position on the display surface;

reading a first flow image representing a flowing condition of the first symbol in a deceleration mode to update the image on the display surface and thereby simulate a movement of the first symbol on a rotating drum such that the display surface virtually rotates; and executing updates of said first flow image on the display surface in the deceleration mode, wherein a first update displays said first flow image at a first location on said display surface, a second update displays said first flow image at a second location which is shifted in location from the first location on said display surface, and a third update displays said first flow image at a third location which is shifted in location from the second location on said display surface and a distance on said display surface from the first location to the second location is bigger than a distance on said display surface from the second location to the third location.

7. A display control method according to claim 6, further comprising the step of:

reading the first flow image in an acceleration mode to update the image on the display surface.

8. A display control method according to claim 6, further comprising the step of:

reading the first flow image in a constant mode to update the image on the display surface.

9. A display control method according to claim 6, further comprising the step of:

reading the first symbol image in the deceleration mode to update the image on the display surface.

10. A display control method according to claim 6, wherein the steps are performed in the recited order and the third update occurs subsequent to the second update and the second update occurs subsequent to the first update.

11. A display control method in a screen display type slot machine having a display with a display surface provided on a plane, said method comprising steps of:

storing symbol images representing a plurality of types of symbols and flow images representing flowing conditions of said symbols;

reading a first symbol image which is one of said symbol images representing a first symbol in a stop mode to update an image at the same position on the display surface;

reading a first flow image representing a flowing condition of the first symbol in a constant mode to update the image on the display surface and thereby simulate a movement of the first symbol on a rotating drum such that the display surface virtually rotates; and executing updates of said first flow image on the display surface in the constant mode, wherein a first update displays said first flow image at a first location on said display surface, a second update displays said first flow image at a second location which is shifted in location from the first location on said display surface, and a third update displays said first flow image at a third location which is shifted in location from the second location on said display surface and a distance on said display surface from the first location to the second location is equal to a distance on said display surface from the second location to the third location.

12. A display control method according to claim 11, further comprising the step of:

reading the first flow image in an acceleration mode to update the image on the display surface.

13. A display control method according to claim 11, further comprising the step of:

reading the first flow image in a deceleration mode to update the image on the display surface.

14. A display control method according to claim 11, further comprising the step of:

reading the first symbol image in a deceleration mode to update the image on the display surface.

15. A display control method according to claim 11, wherein the steps are performed in the recited order and the third update occurs subsequent to the second update and the second update occurs subsequent to the first update.

* * * * *